US005325463A

United States Patent [19]

Murata et al.

[11] Patent Number: 5,325,463

[45] Date of Patent: Jun. 28, 1994

[54] IC CARD WITH BUILT-IN VOICE SYNTHESIZING FUNCTION

[75] Inventors: Yasumoto Murata, Ikoma; Shuichi Yoshikawa; Yuji Nishiwaki, both of Nara, all of Japan

[73] Assignee: Sharp Kabushiki Kaisha, Osaka, Japan

[21] Appl. No.: 827,211

[22] Filed: Jan. 30, 1992

[30] Foreign Application Priority Data

Feb. 1, 1991 [JP] Japan ..... 3-012003

[51] Int. Cl.[5] ..... G10L 5/02

[52] U.S. Cl. ..... 395/2.75; 395/2.76; 381/51

[58] Field of Search ..... 381/51; 395/2.75, 2.76

[56] References Cited

U.S. PATENT DOCUMENTS

| | | | |
|---|---|---|---|
| 4,354,056 | 10/1982 | Brantingham et al. | 381/51 |
| 4,635,211 | 1/1987 | Yoshida et al. | 381/51 |
| 4,926,463 | 5/1990 | Ukegawa | 379/88 |

FOREIGN PATENT DOCUMENTS

| | | |
|---|---|---|
| 0277276 | 8/1988 | European Pat. Off. . |
| 0488751A2 | 6/1992 | European Pat. Off. . |
| 2602893 | 2/1988 | France . |

OTHER PUBLICATIONS

Gersho; IEEE Global Telecommunications Conference 83, vol. 1; Nov. 1983; "Speech Waveform Coding Using Vector Quantization;" pp. 193–197.

Chen et al.; IEEE International Conference on Communications; vol. 3, vol. 3; Jun. 1985; "Gain-Adaptive Vector Quantization for Medium-Rate Speech Coding;" pp. 1456–1460.

Davidson et al.; IEEE Journal on Selected Areas in Communications; vol. 4, No. 1; Jan. 1986; "Application of a VLSI Vector Quantization Processor to Real-Time Speech Coding;" pp. 112–124.

*Primary Examiner*—Allen R. MacDonald
*Assistant Examiner*—Richard J. Kim
*Attorney, Agent, or Firm*—Nixon & Vanderhye

[57] ABSTRACT

An IC card with a built-in voice synthesizing function is provided which includes a solid-state memory containing vector-quantized coded data, a pattern generating means for generating patterns each composed of a prescribed number of digital data by repeatedly performing calculations using a recurrence equation with initial values given by coded data read out of the solid-state memory, a converter circuit for limiting the band of each pattern generated by the pattern generating means and converting into an analog voice signal, and a gain control circuit for adjusting the gain of the analog voice signal output from the converter circuit on the basis of gain data read out of the solid-state memory.

18 Claims, 3 Drawing Sheets

IC CARD WITH BUILT-IN VOICE SYNTHESIZING FUNCTION

BACKGROUND OF THE INVENTION

1. Field of the Invention

The present invention relates generally, as is indicated, to an integrated circuit card, hereinafter referred to as an IC card, with a built-in voice synthesizing function. More particularly, the present invention relates to an IC card with a built in voice synthesizing function that is capable of reconstructing voice signals from vector-quantized coded data for production of voice messages and the like.

2. Description of the Prior Art

In the past, to produce voice messages such as a reading of a novel, etc. on an electronic apparatus, it has been necessary, as shown in FIG. 2, to load a magnetic tape 11 with original voice signals recorded thereon into a magnetic tape reproducing apparatus 12 for reproducing the original voice signals.

With the magnetic tape reproducing apparatus 12, however, it is difficult to reduce the size and weight of the apparatus because of the complex mechanism for replaying the magnetic tape 11. Also, there is a limit to the reduction in the size of the magnetic tape 11 itself. Furthermore, since recorded information cannot be randomly accessed, the magnetic tape 11 must be fast-forwarded or rewound to replay the recorded information from the desired position or to return to the starting point of the recording.

As a result, the conventional magnetic tape reproducing apparatus 12 has had the problem that the apparatus not only takes space and hampers portability because of its size but also requires a cumbersome and time-consuming procedure for operation.

Another known method of voice reproduction is by reconstructing the original signal from vector-quantized coded data using a code book.

However, with the method of reproducing voice from vector-quantized coded data, although the device can be constructed entirely from simple electronic circuits, it requires the use of a large-capacity ROM for the code book.

As a result, the conventional voice reproducing device based on vector quantization has had the problem that the provision of a large-capacity ROM makes it difficult to build-in the device into an IC card; making the ROM capacity smaller than necessary would result in degradation in the voice reproduction quality.

In view of the above problems, there is a strong need in the art for an inexpensive, compact, light-weight, and easy-to-operate IC card with a built-in voice synthesizing function, in which vector-quantized coded data is decoded using patterns generated by a recurrence equation such as a pseudo-random sequence.

Accordingly, the present invention overcomes the aforementioned short comings of the above known and similar devices and methods for providing a voice synthesizing function. The present invention is summarized and described in detail below.

SUMMARY OF THE INVENTION

In accordance with the present invention, there is provided an IC card with a built-in voice synthesizing function which is capable of reproducing voice signals on the simple electronic circuits built in the IC card. Therefore, the present invention does not require a complex mechanism such as the one used in a conventional magnetic tape reproducing apparatus; the entire device can be constructed compact and light weight and is easy to operate.

Furthermore, since patterns based on coded data stored in the solid-state memory can be generated using a recurrence equation such as a pseudo-random sequence, the present invention does not require a large-capacity code book containing a large number of patterns and thus, the voice synthesizing function can be built in the IC card easily and it can be manufactured inexpensively.

According to one aspect of the present invention, an IC card with a built-in voice synthesizing function is provided which includes a solid-state memory containing vector-quantized coded data, a pattern generating means for generating patterns each composed of a prescribed number of digital data by repeatedly performing calculations using a recurrence equation with initial values given by coded data read out of the solid-state memory, a converter circuit for limiting the band of each pattern generated by the pattern generating means and converting into an analog voice signal, and a gain control circuit for adjusting the gain of the analog voice signal output from the converter circuit on the basis of gain data read out of the solid-state memory.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but only one or more of the various ways in which the principles of the invention may be employed. Other objects, advantages, and novel features of the invention will become apparent from the following detailed description of the present invention when considered in conjunction with the drawings.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

The preferred embodiments of the present invention will now be described.

Figure 1:
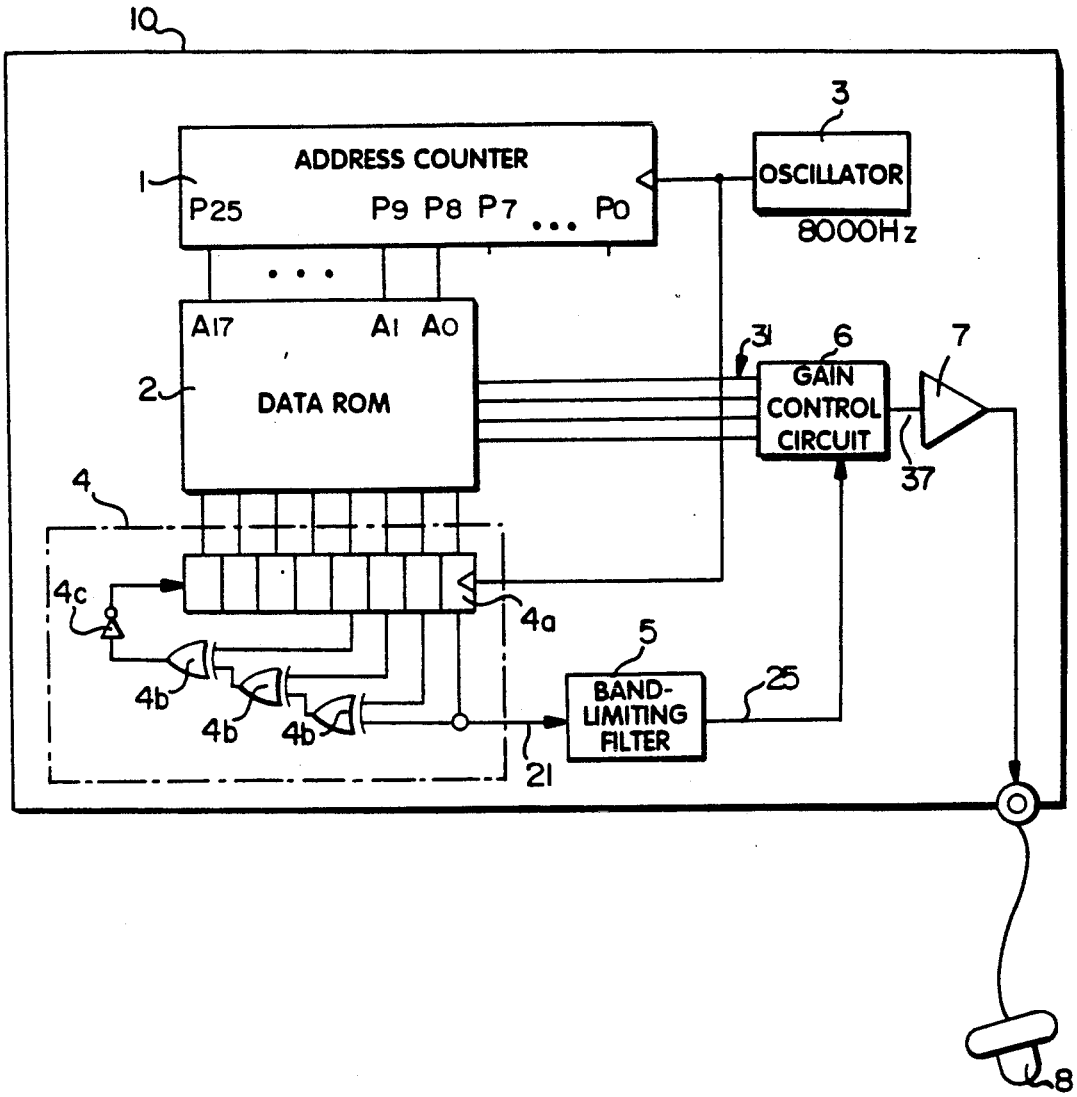
FIG. 1 is a block diagram of an IC card with a built-in voice synthesizing function according to one embodiment of the present invention.
Figure 2:
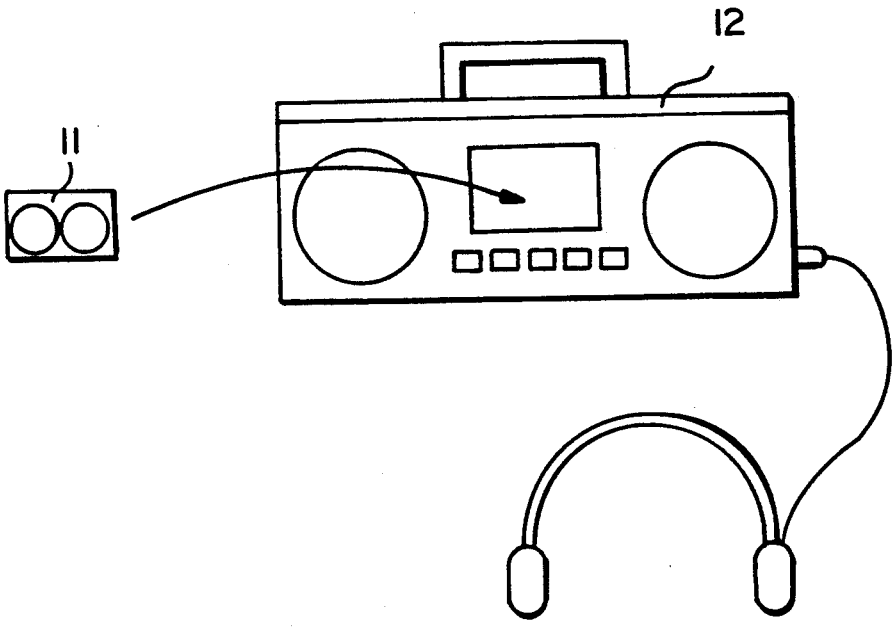
Fig. 2 (PRIOR ART)
FIG. 2 is a front view of a magnetic tape reproducing apparatus in a prior art example.

FIG. 1 is a block diagram of an IC card with a built-in voice synthesizing function according to one embodiment of the present invention.

The IC card 10 with a built-in voice synthesizing function according to the present embodiment contains an address counter 1, a data ROM 2, an oscillator 3, a pseudo-random number generator 4, a band-limiting filter 5, a gain control circuit 6, and an amplifier 7. These circuits are constructed from separate individual ICs (semiconductor integrated circuits) or from ICs combining such individual ICs. An earphone 8 may be connected to the IC card 10.

In the exemplary embodiment, the address counter 1 has a 26-bit output. The most significant 18 bits in the output of the address counter 1 are connected to the 18-bit address input of the data ROM 2. The address counter 1 is a circuit that provides a sequential count at its 26-bit output on the basis of the oscillation frequency (e.g., 8000 Hz) of the oscillator 3. However, since the least significant 8 bits at the output of the address counter 1 are not used in connection with the data ROM 2, the address counter 1 provides the count to the data ROM 2 at a rate of $1/32\times 8$ or ($\frac{1}{2}^8$) of the oscillation frequency of the oscillator 3. The data ROM 2 in the exemplary embodiment is a 12-bit data ROM in which 8-bit coded data and 4-bit gain data are stored in address sequence. Each 8-bit coded data read from the data ROM 2 in response to the count output of the address counter 1 is input in parallel as an initial value, to an 8-bit shaft register 4*a* in the pseudo-random number generator 4.

In the pseudo-random number generator 4, each bit in the shift register 4*a* is sequentially shifted upward based on (i.e., synchronous to) the oscillation frequency of the oscillator 3. The pseudo-random number generator 4 is so configured that the bits in the most-significant four stages or bits of the shift register 4*a* are respectively XORed by three exclusive-OR circuits 4*b* and the result of the final XOR addition is inverted by a NOT circuit 4*c* and is then input to the least significant stage of the shift register 4*a*, and generating pseudo-random numbers of m-sequence and most significant bit is output serially. Thus, with each initial value, the pseudo-random number generator 4 is capable of generating a pseudo-random whose bit train period is 256 ($2^8$). More specifically, each time coded data is given as an initial value from the data ROM 2, the pseudo-random number generator 4 causes the shift register 4*a* to perform $32\times 8$ shifts and thus outputs thirty-two 8-bit data as one pattern.

As is described in detail below, the present invention utilizes the pseudo-random number generator 4 as part of a pattern generating means used for providing the voice synthesizing function. Generally, the pattern generating means sequentially reads out vector-quantized coded data from the solid-state memory data ROM 2 by generating addresses using, for example, the address counter 1. The readout coded data are given as initial values to the recurrence equation, and calculations are repeatedly performed with each given initial value to generate a pattern comprising a prescribed number of data. The recurrence equation (also commonly referred to as a difference equation) is an equation that generates an infinite number of data trains by repeatedly performing calculations with given initial values. With the same initial value, the data trains generated are always identical. Therefore, by giving an initial value to the recurrence equation, the desired data train or pattern can be accessed randomly.

The recurrence equation used in the pattern generating means is the same one as used when the original data was encoded by vector quantization in making code data to store in the solid-state memory data ROM 2. In encoding the data according to the present invention, a large number of patterns generated by sequentially giving different initial values to the recurrence equation are compared with each block of voice signal comprising a prescribed number of samples, and the initial value that generate the closest pattern to the original is code data. Therefore, each pattern that the above pattern generating means generates is the pattern decoded from the corresponding coded data. Furthermore, since the recurrence equation performs repeatedly a prescribed number of calculations with each given initial value, the pattern generated has a larger number of bits than the initial value. This means that the coded data stored in the solid-state memory is obtained by compressing the original voice signal. The recurrence equation may be implemented in either hardware or software.

The patterns used in the encoding process serve as representative vectors in vector quantization. Therefore, when a pattern comprising an N number of data is considered an N-dimensional vector, the patterns that the recurrence equation generates in accordance with initial values must be distributed as uniformly as possible in N-dimensional signal vector space. As a recurrence equation that generates such patterns, the m-sequence method (maximum-length linearly recurring sequence) may be suitably used in order to generate pseudo-random numbers. The m-sequence method for generating pseudo-random numbers also has the advantage that it can be implemented in simple hardware using a shift register. However, since the primary purpose of the use of a recurrence equation in the present invention is to obtain a large number of representative vectors uniformly distributed in signal vector space regardless of the sequence of their generation, all the properties of random numbers are not necessarily required. Therefore, in some cases, a recurrence equation which is not really suitable for the generation of random numbers or which sequentially generates data trains regularly may be acceptable. In generating pseudo-random numbers, the initial value is called the seed.

In the above described encoding process, when each pattern generated by the recurrence equation is compared with a voice signal, the gain of the pattern is adjusted so that the difference between them is minimized. The amount of gain control was added to the selected pattern and stored as gain data in the solid-state memory.

Each pattern generated by the pattern generating means is supplied to the converter circuit such as the band-limiting filter 5 in the preferred embodiment which limits the band of the pattern and is converted into an analog signal. When the pattern generating means reads out coded data from the solid-state memory data ROM 2, the associated gain data is also read out. Based on the thus readout gain data, the gain control circuit 6 adjusts the gain of the analog signal fed from the converter circuit.

The different elements of the present invention, for example the solid-state memory data ROM 2, the pattern generating means including the pseudo-random number generator 4 and address counter 1, the converter circuit including the band-limiting filter 5, and the gain control circuit 6, are built in an IC card. Since the recurrence equation used in the pattern generating means is implemented in simple hardware or software, it is easy to incorporate it in an IC card.

Thus, the present invention achieves reconstruction of voice signals on simple electronic circuits built in an IC card.

Each pattern thus output sequentially from the pseudo-random number generator 4 is converted into an analog signal by the band-limiting filter 5 and is then transferred to the gain control circuit 6. In the meantime, 4-bit gain data read from the data ROM 2 is input to the gain control circuit 6. Based on the input gain data, the gain control circuit 6 adjusts the gain of the analog signal fed from the band-limiting filter 5. The amount of gain adjustment varies with each pattern output from the pseudo-random number generator 4.

Each coded data contained in the data ROM 2 was obtained by vector quantization whereby each block of voice signal comprising 32 samples was compared with every pattern generated by a pseudo-random number generator, the same one as the pseudo-random number generator 4, and the initial value given to the pseudo-random number generator that served to generate the closest pattern to the original one was output sequentially. Therefore, each pattern sequentially output from the pseudo-random number generator 4 by taking coded data read from the data ROM 2 as an initial value represents the closest waveform to the waveform representing each block of 32 samples of the original voice signal. Furthermore, the coded data represents the voice signal of 8 bits $\times$32 samples compressed into 8-bit data serving as an initial value for the pseudo-random number generator 4.

In the above vector quantization process, the comparison was made after adjusting the gain of each pattern so that the difference between the pattern and the voice signal was minimized. The amount of gain adjustment for the closest pattern was stored in the data ROM 2 together with the coded data. The gain of each analog signal delivered from the pseudo-random number generator 4 via the band-limiting filter 5 is sequentially adjusted by the gain control circuit 6 to achieve faithful reconstruction of the original voice signal. Since such gain adjustment serves to seemingly increase the number of patterns generated by the pseudo-random number generator 4, it contributes to enhancing the voice reproduction quality. However, data compression ratio decreases by the degree equivalent to four bits of the gain data.

The analog signal whose gain has thus been adjusted by the gain control circuit 6 is amplified by the amplifier 7 and reproduced as a voice through the earphone 8 connected to the IC card 10.

Thus, according to the present embodiment, vector-quantized coded data can be reconstructed into a voice signal by using the simple pseudo-random number generator 4 built in the IC card 10. Furthermore, the desired voice can be reproduced instantly by random-accessing the coded data stored in the data ROM 2.

Figure 3:
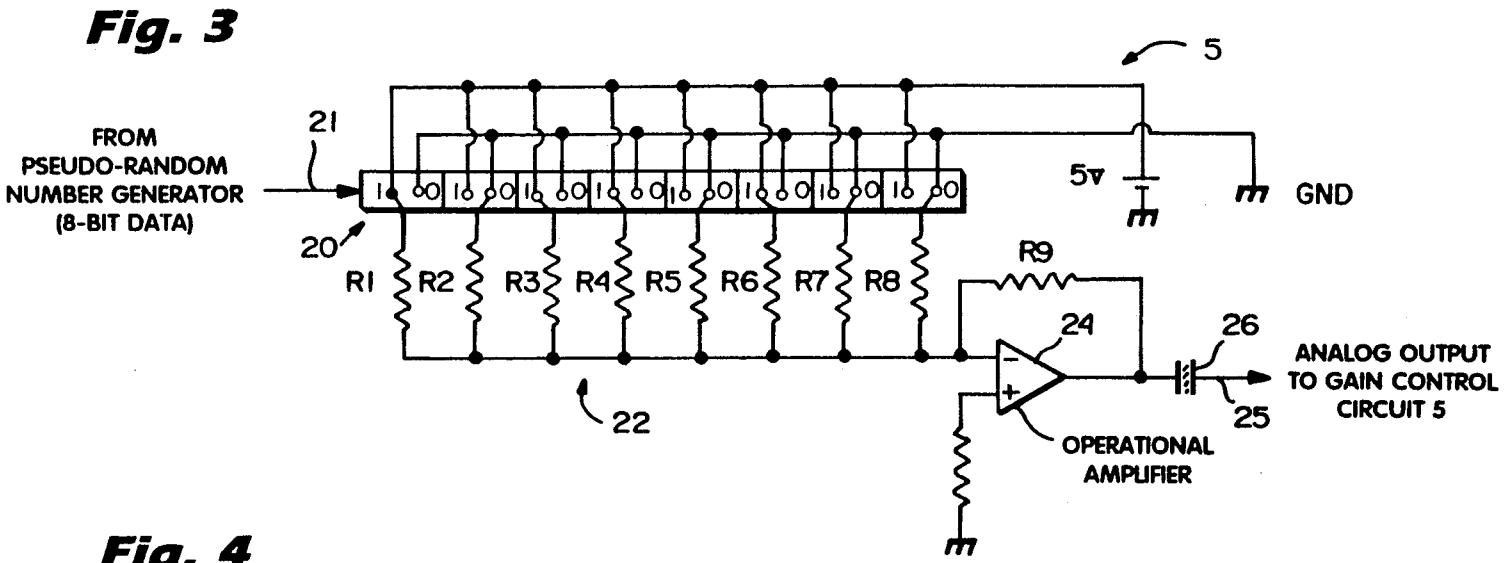
FIG. 3 is a detailed schematic of the band-limiting filter referred to in FIG. 1 in accordance with one embodiment of the present invention.

Referring briefly to FIG. 3, an exemplary embodiment of the band-limiting filter 5 according to the present invention is shown. The band-limiting filter 5 includes a shift register 20 for receiving the serial data from the pseudo-random number generator 4 via line 21. The band-limiting filter 5 further includes a resistive network 22 including a resistor R1–R8 which corresponds to each bit in the register 20. Each resistor R1–R8 is connected to the inverting input of an operational amplifier 24. The non-inverting input of the operational amplifier is coupled to a common ground by way of resistor R10. Resistor R9 serves as a feedback resistor between the output of the operational amplifier 24 and the inverting input. The output of the amplifier 24 is connected via line 25 to the gain control circuit 6 by way of a coupling capacitor 26.

In operation, the contents of each bit in the register 20 determine whether the corresponding resistor R1–R8 is coupled to the 5-volt supply voltage (e.g., when the contents of the particular bit is a "1" or a logic "high" level), or is coupled to GND (e.g., when the contents of the bit is a "0"). Thus, the contents of the shift register 20 determine what will be the analog output of the operational amplifier 24 as will be appreciated. Accordingly, the band-limiting filter 5 of FIG. 3 can be used to convert the data received from the pseudo-randum number generator 4 into an analog signal.

Figure 4:
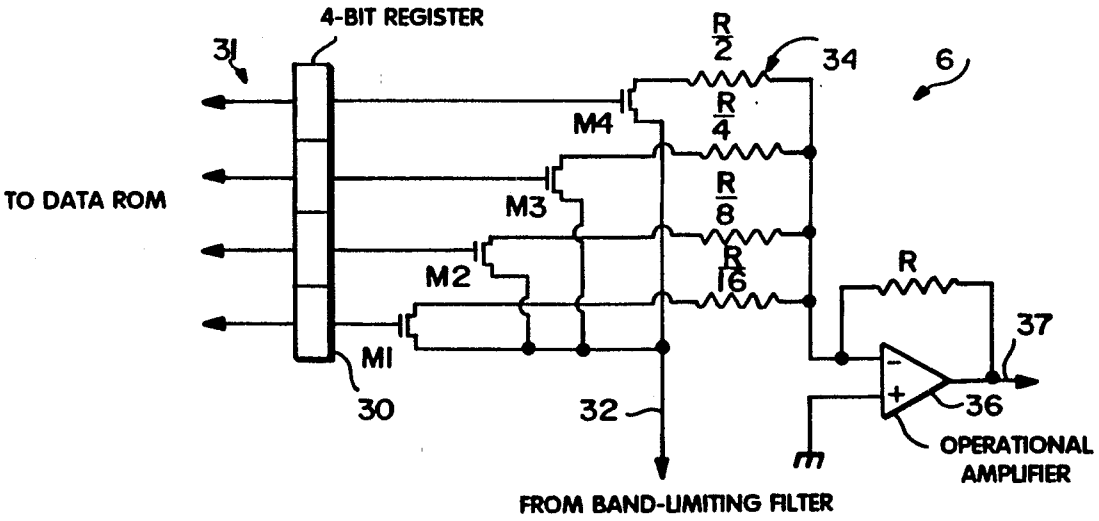
FIG. 4 is a detailed schematic of the gain control circuit referred to in FIG. 1 in accordance with one embodiment of the present invention.

FIG. 4 illustrates an exemplary embodiment of the gain control circuit 6 in accordance with the present invention. The gain control circuit 6 includes a 4-bit register 30 for receiving gain data from the data ROM 2 via bus 31. The output of each register 30 is connected to the gate of a corresponding transistor M1–M4. The analog output signal from the band-limiting filter 5 is received by the gain control circuit 6 on line 25 and is coupled to the respective transistors as illustrated. The remaining terminal of each transistor is coupled through a resistor gain network 34 to the inverting input of an operational amplifier 36.

Based upon the gain data in the register 30, the contents or value of each bit in the register 30 determine whether the corresponding transistors M1–M4 are turned on or off as will be appreciated. As a result, the gain provided to the signal on line 25 due to the resistor gain network 34 in combination with operational amplifier 36 is controlled as a function of the gain data received from the data ROM 2. The output of the gain control circuit 6 is provided on line 37 to the amplifier 7. The amplifier 7 is used to drive the earphone 8.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An apparatus with a built-in voice synthesizing function, comprising:

a solid-state memory containing vector-quantized coded data;

a pattern generating means, connected to the solid state memory, for generating patterns by repeatedly calculating a recurrence equation using coded data read from the solid state memory, each pattern having a prescribed number of digital data; and a converter circuit for converting said patterns generated by the pattern generating means into an analog voice signal.

2. The apparatus of claim 1, wherein said apparatus is an integrated circuit card.

3. The apparatus of claim 1, further comprising a gain control circuit for adjusting the gain of the analog voice signal output from the converter circuit on the basis of gain data read out of the solid-state memory.

4. The apparatus according to claim 1, further comprising:

an address counter for addressing the solid-state memory to permit access to the vector-quantized coded data.

5. The apparatus according to claim 1, wherein the converter circuit is a band limiting filter.

6. The apparatus according to claim 3, wherein the vector-quantized coded data includes compressed samples of speech and wherein a corresponding gain value is stored in the solid state memory for each compressed speech sample.

7. The apparatus according to claim 6, further comprising:

a gain control circuit for adjusting the gain of the analog voice signal using the gain value corresponding to the compressed speech sample read from the solid state memory.

8. An integrated voice synthesis system, comprising:

a random access semiconductor memory for storing seeds of coded voice data;

a pseudo-random number generator for generating a pseudo-random pattern of data bits using a corresponding seed of coded voice data;

means for limiting the bandwidth of each pattern generated by the pseudo-random number generator to produce an analog signal; and means for generating a synthesized voice signal using the analog signal.

9. The integrated voice synthesis system according to claim 8, wherein the semiconductor memory stores associated gain data for each seed of coded voice data.

10. The integrated voice synthesis system according to claim 9, wherein the means for generating includes a gain control circuit for controlling the amplitude of the synthesized voice signal based on the gain data stored in the semiconductor memory.

11. The integrated voice synthesis system according to claim 10, wherein the gain control circuit includes:

a register for storing and outputting in parallel multiple bits of gain data received from the memory, and a weighting circuit for weighting the analog signal received from the means for limiting based on bit values of the gain data and a weight associated with each bit location of the shift register.

12. The integrated voice synthesis system according to claim 8, wherein the means for limiting includes:

a shift register for serially receiving the pseudo-random pattern of data bits;

a bank of parallel resistors with each resistor connected at one end to a corresponding bit location of the shift register for converting the bit values into respective analog voltages; and an operational amplifier connected to other ends of the parallel resistors for summing the analog voltages to produce the analog signal.

13. The integrated voice synthesis system according to claim 8, wherein the pseudo-random number generator generates the pseudo-random pattern of data bits using an m-sequence method.

14. The integrated voice synthesis system according to claim 8, wherein the pseudo-random number generator generates the pattern of data bits in accordance with a recurrence equation and the seed is an initial value input to the recurrence equation.

15. A method for coding and storing speech for use in a speech synthesis device, comprising:

receiving a block of digitized speech samples;

generating a number of pseudo-randomly generated multi-bit patterns, each pattern corresponding to an associated code having fewer bits than its corresponding pattern;

comparing the block of speech samples to each pattern and selecting the patterns that most closely correlates with the block of speech samples; and storing in a semiconductor memory the code associated with the selected pattern.

16. The method according to claim 15, further comprising:

adjusting a gain associated with the selected pattern to minimize a difference between the selected pattern and the block of speech samples, and storing the adjusted gain in the memory along with the code associated with the selected pattern.

17. A method for synthesizing speech from encoded speech data stored in a semiconductor memory, comprising:

sequentially addressing the semiconductor memory and retrieving encoded speech data;

pseudo-randomly generating a multi-bit pattern based on the retrieved encoded speech data, wherein the pattern has a greater number of bits than the retrieved encoded speech data; and converting the pattern to an analog speech signal.

18. The method according to claim 17, further comprising:

adjusting a gain of the analog speech signal based on gain information stored in the semiconductor memory associated with the retrieved encoded speech data.

* * * * *